United States Patent [19]

Michard et al.

[11] Patent Number: 4,707,183

[45] Date of Patent: Nov. 17, 1987

[54] METHOD OF OPERATING A BLAST FURNACE WITH PLASMA HEATING

[75] Inventors: Jean A. Michard, Ville d'Avray; Lucien De Saint-Martin, Metz, both of France

[73] Assignee: Institut de Recherches de la Siderurgie Francaise (Irsid), Maizieres, les Metz, France

[21] Appl. No.: 800,465

[22] Filed: Nov. 21, 1985

[30] Foreign Application Priority Data

Nov. 21, 1984 [FR] France ..... 84 18075

[51] Int. Cl.[4] ..... C21B 5/52

[52] U.S. Cl. ..... 75/10.22; 266/82

[58] Field of Search ..... 75/11, 41, 10.1, 10.19, 75/10.22; 266/82

[56] References Cited

U.S. PATENT DOCUMENTS

| | | | |
|---|---|---|---|
| 1,917,642 | 7/1933 | Furnas | 75/41 |
| 3,955,963 | 5/1976 | Ponghis et al. | 75/10.22 |
| 4,340,420 | 7/1982 | Santen et al. | 75/11 |
| 4,455,165 | 6/1984 | Santen et al. | 75/10.19 |
| 4,514,219 | 4/1985 | Martin | 75/11 |
| 4,526,612 | 7/1985 | Eriksson et al. | 75/11 |

*Primary Examiner*—Melvyn J. Andrews

*Attorney, Agent, or Firm*—Karl F. Ross; Herbert Dubno

[57] ABSTRACT

A blast furnace, especially for the production of hot metal for the steel industry and operated with a normal charge above the tuyere blast zone, has its hot metal production increased at least temporarily by a lateral injection of metal oxides into the zone. A supply of the thermal energy requirements for the smelting reduction of these metal oxides by electrically operated plasma torches, and the compensation of a overoxygenation resulting from the oxygen contribution of these metal oxides by the introduction of nitrogen.

17 Claims, 1 Drawing Figure

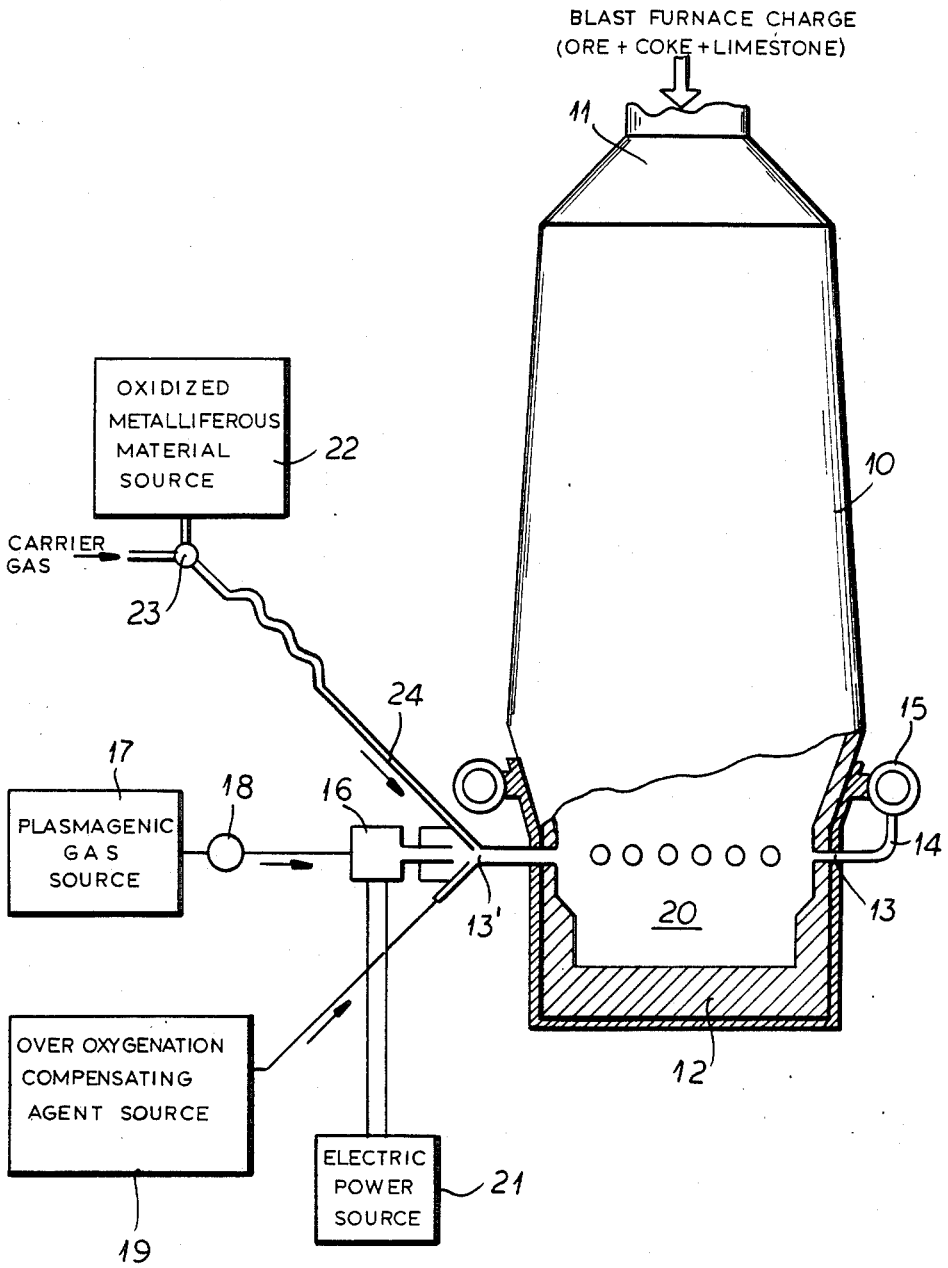
BLAST FURNACE CHARGE
(ORE + COKE + LIMESTONE)
11
10
OXIDIZED METALLIFEROUS MATERIAL SOURCE
22
CARRIER GAS
23
24
15
17
18
16
PLASMAGENIC GAS SOURCE
14
13'
13
20
12
OVER OXYGENATION COMPENSATING AGENT SOURCE
ELECTRIC POWER SOURCE
21
19

METHOD OF OPERATING A BLAST FURNACE WITH PLASMA HEATING

FIELD OF THE INVENTION

Our present invention relates to a method of operating a blast furnace and, more particularly, to a blast furnace producing hot metal for the steel industry and ferrous or chromiferous melts from corresponding metal oxides, hereinafter referred to as oxidized metalliferous material or merely as oxidized material.

BACKGROUND OF THE INVENTION

For over two centuries, the blast furnace has been perhaps the principal apparatus used in the iron and steel industry and its development, not only revolutionized the production of iron and steel, but also allowed such production substantially continuously and in large volumes to the point that, although considerable research has been invested in alternative approaches to the reduction of iron ores, the blast furnace generally remains unequalled.

As is well known, in a blast furnace a charge of sintered iron ore, limestone and/or other slag formers, and coke descends from the top (or throat) of the blast furnace, while a bath of hot metal is formed at the bottom thereof, overlain by a slag layer.

Blast delivered by hot stoves is blown by tuyeres somewhat above the slag layer and reacts with the coke of the charge to produce inter alia carbon monoxide which acts as a reducing agent within the furnace and the exothermicity of the various reactions which take place within the furnace provides the necessary heat to melt the metal formed by the reduction of its ore.

In spite of the fact that blast furnaces have been developed with a high degree of sophistication, in at least one respect they still are deficient. It is not possible, utilizing conventional techniques, to alter at short notice their output.

Put otherwise, the blast furnace has, :n the past, been an apparatus which has been capable of modification as to output only over long periods of time and has been incapable of responding to daily or even hourly changes in demand or required output.

If the blast furnace is operated at a fraction of its capacity, for example, its output can only be increased after a considerable lag from the time at which the demand increase is noted. Furthermore, if the blast furnace is operated at less than full capacity, it tends to operate inefficiently since a full height of charge is usually required for effective pre-heating and reduction.

When the blast furnace is operated at its maximum or rated capacity, however, brief intervals of increased demand can not be satisfied and it is either necessary to provide another blast furnace or auxiliary equipment to satisfy the increased production need, at high capital cost.

The variability obtainable by simply controlling the blast is quite limited and generally, the increased demands are so sporadic as not to warrant the capital expenditure for start-up of additional blast furnaces or their construction.

OBJECTS OF THE INVENTION

It is the principal object of the present invention, therefore, to provide an improved method of operating a blast furnace which permits both brief or prolonged increase or variation in the daily output of a blast furnace without detrimentally effecting the overall operation thereof.

Another object of our invention is to increase the versatility of a blast furnace by making the latter more responsive to commercial and industrial demand and to do so in a simple manner with a high response rate and, of course, without interfering with the customary operational states of the blast furnace.

It is also an object of the invention to provide an improved method of operating a blast furnace which increases the melt output thereof beyond the normal capacity of the furnace.

SUMMARY OF THE INVENTION

These objects and others which will become more readily apparent hereinafter are attained in accordance with the present invention, in an operating process for blast furnace wherein during its normal operation, i.e., an operation wherein the metallurgical ore, slag former and coke charge is reacted to form a bath of hot metal and slag with a blast blown through the tuyeres, we introduce directly in the zone of tuyeres into the furnace an oxidized metalliferous material together with a stream of gas under conditions in which we also supply at the same time the thermal energy necessary for the smelting reduction of said oxidized material, and an agent to compensate the over-oxygenation of the blast induced from said oxidized material.

Specifically, the thermal energy is introduced by heating this stream before it is blown into the furnace by electrical energy, most advantageously with plasma torches, the blast being controlled to maintain substantially unchanged the conditions under which the gases generated in the tuyere zone interact with the charge in the furnace so that the overall functioning of the blast furnace above the blast zone remains substantially the same as usual for the blast furnace without the additional introduction of the oxidized material.

Put otherwise the injection of oxidized material in the tuyere zone and thus below the bulk of the charge in the blast furnace results, because of the oxygen content of this material, in an over-oxygenation of the blast. It is this over-oxygenation effect which is compensated according to the invention by adding a compensating agent, which preferably is gaseous nitrogen in order to form air artificially.

According to a feature of the invention, the oxidized metalliferous material is entrained into the latter in fluidized bed by a carrier gas, as air, or by the electrically heated gas stream or by the blast, or both, the materials being previously treated to have a suitable particle size enabling them to be entrained by either the plasma torch gases or the tuyere blast gases or both. The particle size which can be up to about 1 mm but less than 100 microns, if desired, can be that of fines, powders or the like readily transported pneumatically and may be residues recovered from elsewhere in the steel plant.

While the tuyeres of the furnace can have their blast nozzles partly replaced or completely replaced by plasma torches all or some of which may be operated to yield the energy desired, it is also possible to blow the electrically preheated gas stream into the furnace through existing tuyeres after mixing the electrically preheated gas with the blast coming from the hot blast stoves.

This approach can be used whether the gases are introduced through the tuyeres alone or together with the oxidized metalliferous material in suspension therein. It is also possible, in accordance with the invention, to introduce the plasmagenic gas and the metalliferous particles separately from one another and from the normal blast furnace by different units and at different locations around the perimeter of the furnace.

In another aspect of the invention, the pneumatic transport of the particles can be replaced in part or entirely by a liquid transport, the particles being conditioned in this case to form a slurry with a liquid medium, generally water, which may be introduced into the furnace by a pump.

To summarize, therefore, the invention involves the introduction directly into the tuyere zone of the blast furnace, in addition to the usual blast conventionally provided from the hot stoves, of oxidized metalliferous material which can be reduced to metal additionally recovered in the melt, of plasmagenic gas carrying the thermal energy and derived electrically, necessary to transform this material to molten metal, and of nitrogen or some other agent capable of compensating for the over-oxygenation of the blast resulting from the oxygen contribution of the oxidized material.

These different flows can be introduced separately or can be combined before they are introduced into the blast furnace generally via the usual tuyeres.

The plasmagenic gas may be ambient air or a portion of the blast coming out from the hot stoves or even the nitrogen or a portion of it, sufficient for carrying the required amount of thermal energy for reducing and smelting the mineral matter which is added.

In a iron making blast furnace where the hot metal is recovered and the oxidized metalliferous material which is introduced directly into the tuyere zone is an iron ore, the invention is probably most important. However, the invention is applicable to any blast furnace for any melt and can also be used to vary the composition of the melt which is obtained by appropriate selection of the oxidized material which is added. The invention, without disturbing the ordinary operation of the blast furnace, is thus capable of producing ferrous or chromiferous melts or both, depending upon the nature of the oxidized material which is injected, utilizing only electrically generated energy for the additional heat required and without modifying the charge normally used in the blast furnace, except a possible little increasing of carbon, required for carbonizing the hot metal issuing from said oxidized material. Incidentally, this increasing may be satisfied by the mean of a carbon carrier, as fuel or reducing agent, introduced in the furnace through the tuyeres themself.

BRIEF DESCRIPTION OF THE DRAWING

The above and other objects, features and advantages of the invention will become more readily apparent from the following description, reference being made to the accompanying drawing of which the sole FIGURE is a schematic elevation of a blast furnace, partly broken away, and equipped for carrying out the method of this invention.

SPECIFIC DESCRIPTION

In the drawing, we have shown a blast furnace 10 which is charged at its top 11 with the usual blast furnace charge, namely sintered iron ore, coke and limestone or other slag-forming compositions. Above the base 12 of the furnace upon which the hot metal and slag rest, and from which the melt can be tapped, is the usual row of tuyeres 13, some of which being provided with blast pipes 14 connected to the blast main 15 supplying the blast delivered by the hot stoves (not represented on the FIGURE). In addition, according to the invention, one or more plasma torches 16 supplied by an electrical power source 21 can be provided on the tuyeres as part of or separate from the blast nozzles to introduce a flow of gas in the form of a plasma.

This flow of gas comes out from a plasmagenic source 17 with a flow rate controlled by a valve 18 and, upon heating in the plasma torch, contributes the thermal energy necessary to transform into molten metal an additional oxidized metalliferous material injected into the tuyere zone 20. According to the invention, the plasmagenic gas may be nitrogen, argon, air, a part of the top gas or of the blast coming out from the hot stoves.

In the embodiment illustrated, this oxidized metalliferous material is injected in granulated form from a hopper 22 via a pump device 23 supplied with a carrier gas which may be air and which enables the particles of the oxidized metalliferous material to be pneumatically entrained in the plasma forming air by the mean of a lance 24 which discharges the material in front of the plasma torch 16 into the tuyere 13'.

Since the metalliferous material which is thus introduced is an oxide, its transformation into metal result in an over-oxygenation in the tuyere zone and compensatory adjustment of the blast composition is required. This is accomplished by introducing into the furnace an over-oxygenation compensating agent, from a source 19, which may be coal, coke oven gas, top gas, fuels, etc . . . or the said plasmagenic gas as, preferably, the nitrogen itself. Of course, in such a case, the plasmagenic gas source 17 and the O. C. agent source 19 make a sole and unique supply device.

The effect of the invention is probably best seen from the TABLE annexed to the end of this description.

Column 1 of this table represents the character of a normal operation of a iron making blast furnace for the production of hot iron and which serves as a control for comparison with the results obtained with this invention.

Column 2 shows the application of the principle of the invention utilizing injection of iron ore at a rate of 10% by weight of the hot metal produced in the blast furnace and issuing from the charge introduced at the top (i.e. the passing hot metal).

Columns 3 and 4 show the results obtained with a prereduced iron ore whose oxide content has been reduced by 50% and in which, respectively said iron ore is introduced at 10% by weight and 20% by weight in terms of the metallic iron with respect of the passing hot metal.

As can be seen from column 1 of the table, the blast furnace involved is capable of operating at a maximum rate of 6,000 metric tons of hot metal per day which is supplied with coke introduced at the top of the furnace at a rate of 450 kg per ton of the melt produced, i.e. a daily consumption of 2700 metric tons. The blast furnace is equipped with 28 tuyeres for the blast.

As can be seen by a comparison of column 2 with column 1 the melt produced can be raised to greater than 6500 per day by injecting into the tuyeres, iron ore in a granulated form having particle size less than about 1 mm and preferably of around 200 microns. The rate of iron injected, in terms of the ratio by weight of the iron thus injected to the passing hot metal, is 10%.

Simultaneously with the injection of the iron ore in the tuyere zone, a superheated nitrogen gas is blown, generated by plasma torches such that the additional energy imported to the tuyere zone by the plasma torches satisfies the thermal requirement for the smelting reduction of the oxidized material injected directly into the tuyere zone of the furnace. In the example represented in column 2, the flow rate of the total blown gas is 902 $m^3$ (STP) per ton of hot metal and its temperature is raised by means of the plasma generator to 1777° C. This result is obtained by controlling the plasma torches to that they supply a usable energy of 288 kWh per ton of hot metal.

The superheating of this blowing gas (including blast and nitrogen) is provided here exclusively as already explained to supply the thermal needs of the injected oxidized material so as to maintain the flame temperature in the furnace at 2250° C. and thus without increasing the need for additional metallurgical coke at the top of the furnace which remains the quantity necessary to supply the thermal and chemical requirements of the usual charge introduced at the top.

Indeed, as can be seen from column 2, the consumption of coke per ton of hot iron produced is 35 kg lower than that of the classical operation represented in column 1.

Hence, the amount of coke per ton of passing hot metal remains equal to that used in classical methods, which demonstrates clearly that the charging of the furnace at the top is not modified by injection of the oxidized material within the tuyere zone and that all of the coke serves, as in the classical approach, for the treatment of the passing hot metal.

The method of the invention also permits the internal functioning of the furnace to remain unchanged the flame temperature, the temperature profile within the furnace and both the flow rate and composition of the top gases. It is also possible to carry out the invention with only a minimum modification of the blast furnace to include the plasma torches at the tuyeres so that the operation of the furnace in accordance with classical technique can be utilized independently of such modification.

The oxygen introduced into the furnace by the injected oxidized material is equally taken into account: with purpose to the synthesis of an artificial blast, this oxygen is compensated for by the addition of nitrogen which, in this example, amounts to 103 $m^3$ (STP) per metric ton of hot metal.

The total gas flow introduced into the tuyere zone and by the tuyeres thus is constituted by the blast at 799 $m^3$ (STP) per ton of hot metal and the nitrogen which is added, totaling 902 $m^3$ (STP) per metric ton of melt at a mean temperature of 1777°0 C. To this flow, supplied from the exterior, gas produced by direct reduction of the iron ore which is injected in the tuyeres region is added in the combustion zone of the furnace in front of the tuyeres.

It will be understood that the addition of nitrogen is intended to eliminate the drawbacks which might result from an over-oxygenation of the blast in the tuyere zone by the thermal decomposition or release of oxygen from the iron oxides introduced in accordance with the simplified equation:

$$Fe_xO \rightarrow xFe + \tfrac{1}{2}O_2.$$

The invention eliminates the usual need to increase the amount of coke introduced at the top to compensate the diminution of the temperature of the blast resulting from the over-oxygenation of it, in order to maintain an adequate temperature of the flame.

Thus, according to a feature of the invention, all or part of the nitrogen as compensating agent for over-oxygenation of the blast during the operation may be replaced by auxiliary combustible or fuel (such as methane or some other hydrocarbon) or by pulverulent coal, etc.

It should be noted that the injection of auxiliary combustible into a blast furnace has been known per se for a considerable time (see for example French Pat. No. 1,340,058).

The quantities of nitrogen which are injected need not only be adjusted as a functioning of the oxides injected into the tuyeres zone of the furnace but can, if one wishes, take into consideration the normal parameters of operation of the furnace. For example, if the blast blown through the tuyeres is already over-oxygenated even without an injection of the oxidized material in the normal course of operation of the furnace, this may be compensated for by the introduction of an amount of nitrogen correlatively reduced with comparison of the indications given by the Table.

Thus, there is an entire spectrum of operations which can utilize dilution of the blast with nitrogen to compensate for excess oxygen brought into the tuyere zone of the furnace from the oxidized material injected directly in this zone.

It may also be observed that a part of the oxides which are injected into the tuyeres zone, and one which is relatively small but not insignificant, may also serve for the desilication of the hot metal already in the blast furnace in a reaction of the type:

$$2Fe_xO + Si \rightarrow 2xFe + SiO_2$$

(see the Japanese Pat. No. 56-194005) therefore, without liberating gaseous oxygen and thereby reducing the quantity of nitrogen which must be added.

Columns 3 and 4 show the effect of injecting prereduced iron ore through the tuyeres.

In column 3, for example, where the prereduced iron ore has had its oxide content reduced by 50% by comparison with the example of column 2 and the amount of prereduced ore inejcted represents 10% by weight (in iron) of the passing hot metal, it can be seen that the production rate can be improved to 6507 metric tons per day.

As foreseeable, the amount of coke introduced at the top of the furnace is the same in columns 2 and 3. Since the oxidized material has been reduced by 50%, the thermal requirements and hence the electrical energy utilized is limited by comparison with the case in which crude ore is injected (column 2).

Specifically, the energy used by the plasma torches is reduced in the case of the example of column 3 to 161 kWh per ton of hot metal. The addition of nitrogen can be reduced to 51 $m^3$ (S.T.P.) per ton of hot metal, slightly less than half than in the previous case.

The total amount of gas injected, about 903 $m^3$ (S.T.P) per metric ton of hot metal is equal to that used in the example of column 2 although the temperature of this gas, 1521° C., is substantially lower so as to carry out the thermal requirements of the prereduced iron ore without disturbing the internal functioning of the blast furnace. Indeed, the property of the top gas, as the temperature and profile of the flame are identical to those of column 1 which represents the control.

In the example shown in column 4, we have demonstrated that it is possible to increase the productivity of the blast furnace to 7000 tons of hot metal per day by utilizing a 50% prereduced iron ore injected at the level of the tuyeres at a rate of 20% weight iron or the passing hot metal.

There the plasma torches are controlled to deliver an energy of 296 kWh per ton of hot metal, the total blowing of the melt requiring 832 $m^3$ (S.T.P) per ton of hot metal at a mean temperature of 1840° C.

The amount of coke per ton of hot metal is less than that of the cases previously described although the daily consumption of coke remains the same. This means that the thermal charge of the top gas and the flame temperature are not changed.

Among the advantages of the invention, is the lack of any need to treat the injected oxidized material by an agglomeration apparatus or plant. Another advantage, deriving from the fact that the energy source contributed with the present invention is electric current, is that the injection of the oxidized material and the plasma heating can be interruped and restored practically instantaneously so that normal furnace operation can be replaced or reestablished quickly and the versatility of the blast furnace greatly improved.

The oxidized metalliferous material which is injected need not be ore or prereduced ore, but can include mill scale, powders and dusts recovered from metallurgical furnaces (such as the blast furnace, itself) $O_2$ converters, and even fines which are separate from agglomeration operations, etc . . .

The quantity of said oxidized material injected into the tuyere zone is, in general, limited only by the power of the torches which are available. In practice, the plasma torches, now on the market and which can be used for this purpose, can be the more common torches with powers of 4 to 8 MW although industrial torches of 10 to 12 MW have been or are under development and can also be used.

Various arrangements of the torch in the tuyeres of the blast furnace may be employed. For example, as indicated in column 2 the table, one may inject 1.2 metric tons per hour of crude ore through each of the 28 tuyeres of the blast furnace and to provide each tuyere with a plasma torch having power of 3.3 MW and an electrical efficienct value of 0.85.

Alternatively, 4.8 tons per hour of crude iron ore can be introduced by 7 torch tuyeres only each having a power of 13 MW, the nitrogen serving as the plasmagenic gas (4000 $m^2$ per hour for each torch-tuyere) and the hot blast provided by the hot staves can be distributed over the 21 remaining tuyeres (see FIGURE).

In another alternative, the injection of the oxidized material may be concentrated at 4 torch-tuyeres, each with a power of 23 MW, corresponding to 8.4 tons of crude iron ore and 7000 $m^2$ of nitrogen per torch-tuyere, if one desires to use torches of higher power.

An indication that the method of the invention does not alter the conditions under which the normal charge in the blast furnace is reduced and smelted is the fact that the properties of the top gas remain substantially unchanged from the top gas produced during the blast furnace operation without injection of the oxidized material.

This, of course, requires that the temperature of the flame at the outlets of the blast nozzles of the tuyeres be maintained constant and an adjustment of the flow rate of the blast supplied by the hot staves (whose temperature is usually between about 1100° C. to about 1300° C.), supplemented by control, of course, of the flow rate of the plasmagenic gas. The thermal requirements for the reduction of the injected materials and the smelting reduction thereof is a function of the output of the plasma torches and the nitrogen flow is controlled in the manner previously described.

As a consequence, it can be seen from columns 2 and 3 of the TABLE that as the quantity of the injected iron ore increases, the less free oxygen need be introduced by the blast, and hence the amount of nitrogen must be correlatively increased if one is to avoid drawbacks resulting from over-oxygenation with respect to the normal blast furnace operations. The upper theoretical limit of the quantity of oxidized material which can be injected is, of course, that in which this material would supply all of the oxygen which was formerly delivered by the blast and thus in which all of the adjusted blast could be substituted by nitrogen.

As noted previously, the invention also has the advantage that the oxidized material injected need not be identical to the mineral matter introduced at the top, but may include metallic oxides, whose metal is to be alloyed with the iron ultimately to be incorporated into a steel into which the hot metal is to be transformed. For example, when the injected oxidized material is a chromium oxide such as chromium ore, a chromium melt can be obtained and when the top charge utilizes iron ore and chromium ore is injected, a ferrochrome or chromiferous melt may be obtained such products are particularly desirable for the production of stainless steel.

In the art, chromium alloys have frequently required various furnaces in addition to the blast furnace, e.g. electrical furnaces for producing ferrochrome.

To a certain extent, therefore, the blast furnace, used in accordance with the invention, functions as a single reactor having two superposed stages, each specializing in a different product namely, hot iron produced by the upper stage from the top charge and a ferrochrome produced by the lower stage from the injected oxidized material, the two liquid phases combining in the base of the furnace from which the chromium melt may be tapped.

This allows, for example, the properties of chromium in the melt to be adjusted by control of the amount of chromium-oxide material injected.

Another advantage of the present invention appears by the fact that chromium oxides, as opposed to iron oxides, can be reduced only directly by carbon and thus only into the tuyere zone where especially high temperatures prevail (i.e. 1100° C. and more). The direct injection of this chromium ore into the tuyere zone, combined with the superheating of blown gas by the electrcal energy of the plasma torches, ensure the preheating of the chromium oxide, and, above all, the reduction of said chromium oxide.

Therefore, the coke requirements per ton of chromiferous hot metal are reduced with respect to classic methods and the gases which emerge from the furnace have a higher degree of oxidation and thus are energetically more depleted, thereby demonstrating an improved thermal efficiency for the blast furnace.

If, of course, the quantity of oxidized material which can be injected is limited because of the available power of the plasma torches, it is possible to introduce a portion of the chromium oxide in the top charge of the furnace although this has certain drawbacks.

It has been seen that the injection of metal oxides together with electrical energy allows a conservation in the coke rate per ton of passing hot metal when nitrogen is added. While the addition of nitrogen is certainly relatively simple and convenient, it remains possible that, in certain cases, the supply of nitrogen or quantities available of nitrogen may be insufficient. In such a case, we may introduce into the blast through the tuyeres auxiliary combustibles of fuels such as hydrocarbon liquids or gases especially natural gas, coke oven gas or coal.

We have used various terms to describe the role of nitrogen (or auxiliary combustibles) as an over oxygenation compensating agent. However, these terms do not mean that the amount of nitrogen must be adjusted in order to realise in the furnace a ratio $N_2/O_2$ which corresponds exactly to those normally present in the blast for the conventional blowing of the furnace regardless of the source of the oxygen.

The added nitrogen, therefore, prevents detriment from over oxygenation so that the upper part of the furnace operates practically identically whether or not an oxidized material is injected directly into the tuyere zone of the furnace.

While the invention has been described specifically for blast furnaces, producing hot metal for the steel industry it will be understood that this is merely the preferred use and that the method can be employed for the operations of blast furnaces of other types. For example, furnaces for the production of ferro-manganese in which case the oxidized metalliferous material injected into the zone of the tuyeres will include manganese ore.

| | Table Reference 1 | Operation with Injection of iron ore 2 | 3 | 4 |
|---|---|---|---|---|
| Hot metal Production t/Day | 6 000 | 6 507 | 6 507 | 7 000 |
| Degree of reduction of iron ore injected % | 0 | 0 | 50 | 50 |
| Iron Injected/passing hot metal produced % | 0 | 10 | 10 | 20 |
| Coke introduced at the furnance top | | | | |
| kg/tF | 450 | 414 | 414 | 395 |
| t/Day | 2 700 | 2 694 | 2 694 | 2 695 |
| Plasma Torch Energy kWh/tF | 0 | 288 | 161 | 296 |
| Flow of Blast $Nm^3/tF$ | 1 016 | 799 | 852 | 738 |
| Flow of $N_2$ Added $Nm^3/tF$ | 0 | 103 | 51 | 94 |
| Flow of total gas $Nm^3/tF$ | 1 016 | 902 | 903 | 832 |
| Temperature of total Gas injected °C. | 1 200 | 1 777 | 1 521 | 1 840 |
| Top Gas | | | | |
| Flow rate $Nm^3/h$ | 382 550 | 378 870 | 378 870 | 375 410 |
| temperature °C. | 107 | 109 | 109 | 112 |
| Calorific content $Kcal/Nm^3$ | 674 | 675 | 675 | 676 |
| Temperature of Flame °C. | 2 254 | 2 254 | 2 254 | 2 254 |

We claim:

1. A method of operating a top-charged blast furnace having a tuyere zone at which a blast of gas is injected into said furnace below a charge containing iron ore and coke so that with said blast, iron produced by reduction of the ore with the coke is smelted in a normal blast furnace iron and steel making operation for a normal rate of iron production with a certain gaseous oxygen content of the blast in the absence of heat supplied from a source other than reaction of the coke with the blast, said method comprising the steps of:

(a) introducing said charge into the top of said furnace, feeding said blast of gas into said tuyere zone, and collecting molten metal below said tuyere zone;

(b) for temporarily increasing the iron output of said furnace injecting directly into said furnace at said zone laterally particles of oxidized metalliferous material;

(c) introducing into said furnace directly in said zone a gas stream previously heated by electric energy to deliver to said charge and said zone thermal energy in an amount sufficient to supply the thermal energy required for smelting reduction of the oxidized metalliferous material injected into said zone in step (b), the injection of said oxidized metalliferous material into said zone inducing an over oxygenation in said zone; and (d) controlling the blast used, introducing into said zone laterally and directly a compensating agent for compensating for said over oxygenation induced by the injection of said oxidized metalliferous material in said zone, and controlling the rate of introduction of said compensating agent to ensure that smelting reduction of said charge proceeds above said zone in conformity with said normal blast furnace iron and steel making operation in spite of the injection of said oxidized metalliferous material into said zone and the reduction of the gaseous oxygen content of the blast used.

2. The method defined in claim 1 wherein said gas stream previously heated electrically is heated by passing said gas stream through a plasma torch.

3. The method defined in claim 2 wherein said compensating agent is nitrogen gas.

4. The method defined in claim 3 wherein said gas stream is constituted at least in part by nitrogen gas.

5. The method defined in claim 1 wherein said oxidized metalliferous material is entrained into said zone in a gas flow.

6. The method defined in claim 1 wherein said oxidized metalliferous meterial is introduced into said zone in a slurry.

7. The method defined in claim 1 wherein said oxidized metalliferous material is an iron ore.

8. The method defined in claim 7 wherein said oxidized metalliferous material is a partially reduced iron ore which has been prereduced before being introduced into said zone.

9. The method defined in claim 1 wherein said oxidized metalliferous material is chromium oxide.

10. The method defined in claim 1 wherein said oxidized metalliferous material is a mixture of chromium oxide with iron oxide.

11. The method defined in claim 1 wherein said compensating agent is a fuel substance selected from the group which consists of liquid and gaseous hydrocarbons, coke-oven gas and coal.

12. The method defined in claim 2 wherein said furnace has tuyeres opening into said furnace at said zone and feeding said blast to said zone, said plasma torch being provided in one of said tuyeres.

13. A method of operating a blast furnace for producing chromium-containing pig iron comprising tuyeres for introducing hot blast air into said furnace which comprises the steps of:

(a) introducing a charge at the top of the blast furnace including a reducing agent and a metal oxide in a normal blast furnace operation for the production of a metal selected from the group consisting of iron and steel while feeding blast into the tuyeres zone of said furnace, below which hot metal is collected;

(b) injecting directly into said zone, at least temporarily during operation as in step (a), oxidized metalliferous metal comprising chromium ore;

(c) introducing directly into said zone a gas stream previously heated by electric energy to deliver energy sufficient to supply the thermal energy required for the smelting reduction of said oxidized metalliferous material; and (d) controlling said blast, introducing an agent for compensating for overoxygenation induced by injecting of chromium ore in the said tuyere zone and controlling said introduction of said agent for compensating for overoxygenation to ensure that smelting reduction of the top charge above said zone continue to conform to said normal blast furnace operation, while said oxidized metalliferous material is introduced into said zone.

14. The method defined in claim 13 wherein the chromium ore is chromium oxide.

15. The method defined in claim 13 wherein said oxidized metalliferous material further comprises iron oxide.

16. The method defined in claim 13 wherein said over oxygenation compensating agent is a nitrogen gas.

17. In a blast furnace having tuyeres for introducing in a normal blast furnace operation for iron and steel making and a blast to a top charge located above a combustion zone into which said tuyeres open, the improvement which compises in combination;

(a) means for introducing laterally into said combustion zone at least one oxidized metalliferous material while said charge is reacted to produce hot metal with blast blown from said tuyeres;

(b) at least one plasma torch attached to a respective one of said tuyeres for heating a gas stream electrically before it is introduced into said zone;

(c) means for controlling said gas stream when said oxidized metalliferous material is introduced, in order to supply the thermal requirements for the smelting reduction of said oxidized metalliferous material;

(d) means for controlling said blast;

(e) means for introducing into said zone an agent for compensating for overoxygenation; and (f) means for controlling said compensating agent in order to compensate overoxygenation resulting from the oxygen content of the oxidized metalliferous material injected, to ensure that smelting reduction of the top charge above said zone continue to conform to said normal blast furnace operation while said oxidized metalliferous material is introduced into said zone.

* * * * *